United States Patent [19]

McCurdy

[11] 3,965,710

[45] June 29, 1976

[54] DOOR LOCK WITH DECORATIVE ESCUTCHEON

[75] Inventor: Donald L. McCurdy, Rockford, Ill.

[73] Assignee: Amerock Corporation, Rockford, Ill.

[22] Filed: Apr. 14, 1975

[21] Appl. No.: 568,121

[52] U.S. Cl. ..... 70/452; 70/422

[51] Int. Cl.[2] ..... A47B 95/04; E05B 15/02

[58] Field of Search ..... 70/370, 416, 417, 422, 70/451, 452; 85/61; 248/27, 203

[56] References Cited

UNITED STATES PATENTS

| | | | |
|---|---|---|---|
| 326,507 | 9/1885 | Kelly | 70/370 X |
| 1,739,964 | 12/1929 | Hainline | 70/422 UX |
| 3,191,486 | 6/1965 | Gibbens | 85/61 |
| 3,267,792 | 8/1966 | Yackle | 85/61 |
| 3,449,934 | 6/1969 | Check | 70/452 X |
| 3,630,054 | 12/1971 | Malminen et al. | 70/452 |
| 3,713,683 | 1/1973 | Neary | 70/451 X |
| 3,751,953 | 8/1973 | Newman | 70/452 X |

FOREIGN PATENTS OR APPLICATIONS

| | | | |
|---|---|---|---|
| 1,553,372 | 9/1969 | Germany | 70/452 |
| 432,281 | 9/1967 | Switzerland | 70/452 |

*Primary Examiner*—Roy D. Frazier
*Assistant Examiner*—Lawrence J. Staab
*Attorney, Agent, or Firm*—Leydig, Voit, Osann, Mayer & Holt, Ltd.

[57] ABSTRACT

A door lock in which a decorative escutcheon is telescoped onto a tubular barrel which houses a lock cylinder. A key on the escutcheon fits into a slot in the barrel and normally holds the escutcheon in a proper angular orientation with respect to the barrel. If the escutcheon is forcibly turned with a pipe wrench or the like, the key shears away and allows the escutcheon to spin freely on the barrel so as to prevent torque from being transmitted to the barrel.

2 Claims, 4 Drawing Figures

DOOR LOCK WITH DECORATIVE ESCUTCHEON

BACKGROUND OF THE INVENTION

This invention relates to a door lock and, more particularly, to a lock of the type in which a lock cylinder is secured within a generally cylindrical barrel and is operable, when actuated by a key, to cause retraction of a latching bolt. The invention is even more specifically concerned with a lock having a decorative escutcheon which is telescoped over the outer end portion of the barrel and which is formed with a generally centrally located opening for receiving the outer end portion of the lock cylinder.

SUMMARY OF THE INVENTION

The general aim of the present invention is to provide a new and improved door lock having an angularly asymmetrical escutcheon which normally is secured to the barrel and is held in a predetermined angular orientation but which releases from and spins on the barrel if a burglar attempts to break the lock by applying torque to the escutcheon with a wrench or the like.

A more detailed object is to achieve the foregoing through the provision of a unique lock in which a frangible key normally holds the escutcheon against angular movement on the barrel. If abnormal torque is applied to the escutcheon, the key shears away and allows the escutcheon to turn on the barrel so as to prevent the torque from being transmitted to the barrel.

These and other objects and advantages of the invention will become more apparent from the following detailed description when taken in conjunction with the accompanying drawings.

DETAILED DESCRIPTION OF THE PREFERRED EMBODIMENT

Figure 2:
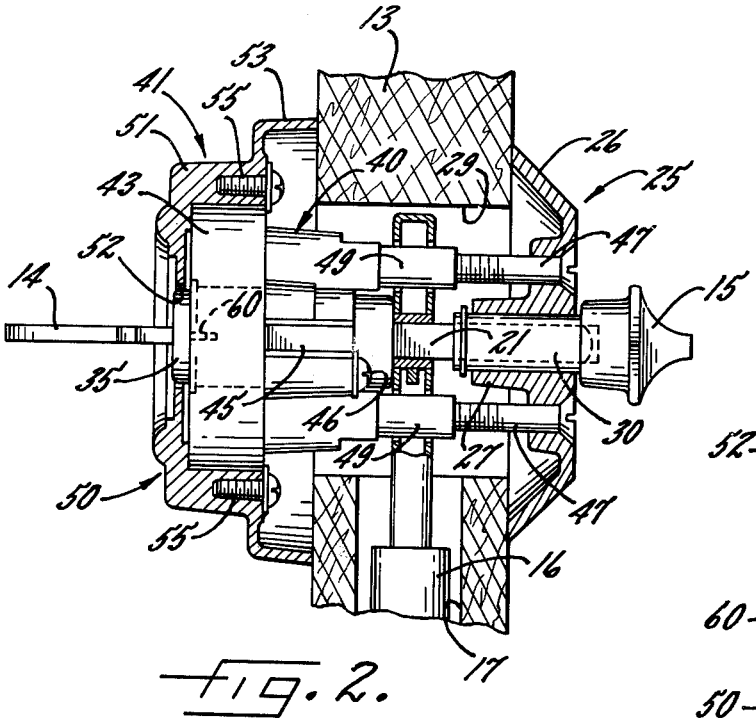
FIG. 2 is an enlarged fragmentary cross-section taken substantially along the line 2—2 of FIG. 1.

As shown in the drawings for purposes of illustration, the invention is embodied in a deadlock 10 having a latching bolt 11 which may be selectively actuated to hold a hinged door 13 in a locked condition relative to a jamb (not shown). The deadlock shown is of the so-called single-cylinder type in that locking and unlocking of the bolt from the outside of the door are carried out by means of a key 14 while locking and unlocking from the inside may be accomplished without the use of a key by actuating a thumb knob 15 (FIG. 2).

Figure 1:
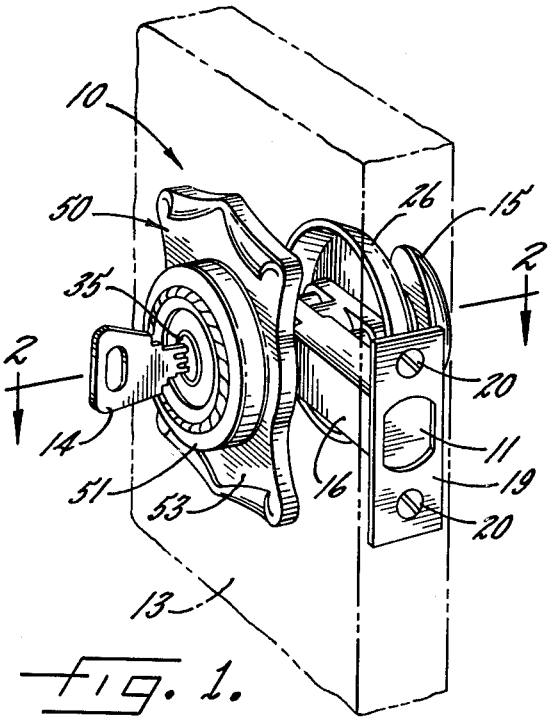
FIG. 1 is a perspective view showing a door equipped with a new and improved lock embodying the novel features of the present invention.

The latch bolt 11 is of the usual construction and is supported to slide back and forth within a housing 16 (FIG. 1) mounted in a hole 17 (FIG. 2) opening out of the edge of the door 13, the housing being attached rigidly to a face plate 19 which is anchored to the door by screws 20. Movement of the bolt between its latched and unlatched positions is effected by turning a driver bar 21 which extends through a hole in the bolt housing 16 and which is connected to the bolt by conventional linkage (not shown), the latter serving to reciprocate the bolt in response to turning of the driver bar.

The thumb knob 15 is used to turn the driver bar 21 from the inside of the door 13 and forms part of the interior unit 25 of the deadlock 10. As shown in FIG. 2, the interior unit includes a die cast escutcheon 26 having an inner side adapted to lie adjacent the interior face of the door and having a decorative outer side. Cast integrally with and extending inwardly from the inner side of the escutcheon is a tubular boss 27 which projects into an opening 29 extending through the door and communicating with the hole 17. An elongated shank 30 on the inner end of the thumb knob 15 is rotatably journaled within the boss 27 and is formed with a drive slot which telescopically receives one end portion of the driver bar 21, the slot being shaped to cause turning of the bar when the thumb knob is rotated.

Figure 3:
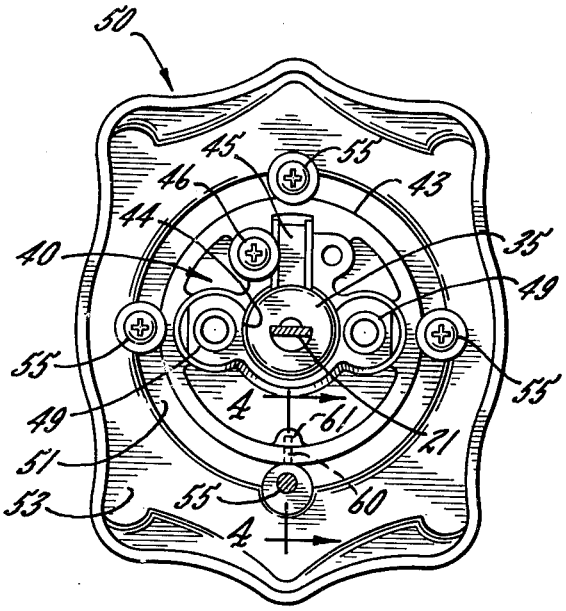
FIG. 3 is an elevational view showing the inner side of the barrel and the escutcheon.

To enable latching and unlatching of the bolt 11 from the outside of the door 13 by means of the key 14, the deadlock 10 includes a conventional tumbler-type lock cylinder 35 (FIGS. 1, 3 and 4) which is adapted to rotate the driver bar 21 when the key is inserted into the cylinder and turned. The outer end portion of the driver bar 21 is fitted into a slot in the inner end of the rotatable part of the cylinder and thus is turned when the key is turned.

Figure 4:
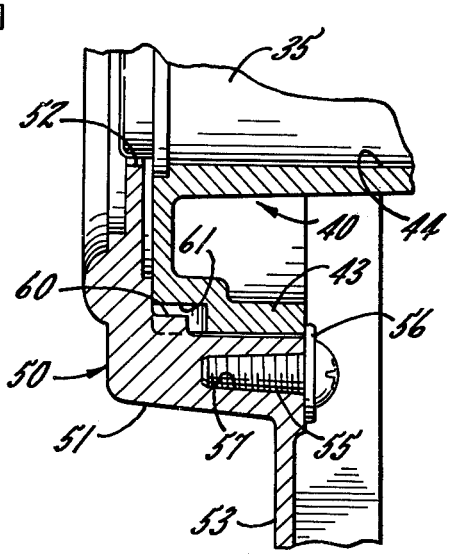
FIG. 4 is an enlarged fragmentary cross-section taken substantially along the line 4—4 of FIG. 3.

The lock cylinder 35 is rigidly supported within a die-cast tubular barrel 40 which forms part of the exterior unit 41 of the deadlock. As shown in FIGS. 2 and 4, the barrel 40 is defined by a substantially cylindrical shell 43 and by an inwardly projecting mass of metal which is sized to telescope loosely into the opening 29 in the door 13. The lock cylinder 35 is fitted into a hole 44 extending through the central portion of the barrel 40 and is held in a fixed angular position by an integral key 45 (FIG. 3) fitting into a keyway formed in the barrel. A screw 46 is threaded into the barrel and its head clamps against the key 45 to retain the lock cylinder in the hole 44.

Two threaded screws 47 (FIG. 2) are used to connect the interior and exterior units 25 and 41 to the bolt housing 16 and to anchor the deadlock 10 to the door 13. As shown in FIG. 2, the screws 47 are disposed with their heads located on the inside of the door 13 and are adapted to extend through a pair of horizontally spaced holes in the interior escutcheon 26. At their threaded ends, the screws are threaded into holes which are formed in a pair of horizontally spaced and horizontally extending posts 49. The latter are cast integrally with the barrel 40 and extend through holes in the bolt housing 16. Accordingly, the screws 47 and the posts 49 coact to secure the interior unit 25, the bolt housing 16 and the exterior unit 41 to one another and to fasten the entire assembly to the door 13.

The exterior unit 41 is completed by an outer decorative escutcheon 50 which is cast from zinc alloy or the like. The outer escutcheon 50 includes a substantially cylindrical tubular portion 51 sized to telescope over the shell 43 of the barrel 40 and formed with a central opening 52 for receiving the outer end portion of the lock cylinder 35. Formed integrally with the tubular portion is a rim 53 whose inner side is adapted to lie face-to-face with the outer side of the door 13. The rim is angularly asymmetrical in that it is generally rectangular and includes two comparatively long upright sides and two shorter and substantially horizontal sides.

In accordance with the present invention, the angularly asymmetrical escutcheon 50 is secured to the barrel 40 in such a manner as to be normally held in a predetermined angular orientation on the barrel while being capable of rotating on the barrel if a potential burglar attempts to twist off the screws 47 or posts 49 by turning the escutcheon with a pipe wrench or the like. As a result, proper angular orientation of the escutcheon 50 normally is maintained and yet any excessive torque which might be applied to the escutcheon cannot be transmitted to the screws and the posts.

More specifically, the escutcheon 50 is held against outward axial movement along the barrel 40 by four angularly spaced screws 55 (FIGS. 3 and 4) each having an enlarged washer 56 formed integrally with its head. Each screw 55 is threaded into an axially extending hole 57 formed in the tubular portion 51 of the escutcheon and is positioned with its washer 56 located against the inner end of the shell 43. Thus, the screws 55 prevent the escutcheon from being pulled axially away from the barrel but leave the escutcheon free to rotate on the barrel.

In keeping with the invention, rotation of the escutcheon 50 on the barrel 40 normally is prevented by a key-and-slot connection between the escutcheon and the barrel. Herein, such connection is defined by a generally rectangular key 60 (FIG. 4) which is formed integrally within the bottom part of the tubular portion 51 of the escutcheon adjacent the outer wall thereof. The key is sized to fit snugly but slidably into a substantially correspondingly shaped slot 61 which opens radially and axially out of the lower part of the shell 43 of the barrel 40. Accordingly, the key 60 and the slot 61 prevent rotation of the escutcheon 50 on the barrel 40 and keep the escutcheon angularly oriented with respect to the door 13 and the lock cylinder 35 so that the two longer sides of the escutcheon will always extend substantially vertically.

The key 60 is of narrow radial width and thus is comparatively frangible. If a burglar applies torque to the escutcheon 50 with a pipe wrench, the narrow key 60 shears off within the slot 61 and allows the escutcheon to turn freely on the barrel 40. Thus, torque cannot be transmitted from the escutcheon to the screws 47 and the posts 49 and hence the burglar cannot break the screws and the posts by turning the escutcheon.

I claim:

1. The combination of a lock and a door; said door having inner and outer sides and having a hole extending therethrough between said sides; said lock comprising an exterior unit for the outer side of said door and an interior unit for the inner side of said door; said exterior unit comprising (1) a cylindrical barrel, (2) a lock cylinder secured rigidly within and coaxial with said barrel and projecting outwardly therefrom, (3) a decorative escutcheon telescoped over the outer end portion of said barrel and having an opening coaxial with said barrel and rotatably receiving the outer end portion of said lock cylinder, and (4) connecting means for preventing axial separation of said escutcheon and said barrel while permitting said escutcheon to rotate relative to said barrel and said lock cylinder; fastening means extending through said hole and connected between said barrel and said interior unit to anchor said interior and exterior units rigidly to said door, and a key-and-slot connection between said escutcheon and said barrel for retaining said escutcheon in a predetermined angular orientation with respect to said lock cylinder, the key of said connection having less shear strength than said fastening means and shearing away when excessive torque is exerted on said escutcheon so as to enable said escutcheon to turn about the axis of said barrel and said lock cylinder and thereby prevent said excessive torque from being transmitted to said barrel and fracturing said fastening means.

2. The combination defined in claim 1 in which the slot of said connection is formed in said barrel and opens axially out of the inner end of said barrel, the key of said connection being formed integrally with said escutcheon.

* * * * *